US010647557B2

(12) United States Patent
Insam et al.

(10) Patent No.: US 10,647,557 B2
(45) Date of Patent: May 12, 2020

(54) DEVICE AND METHOD FOR CONTROLLING AN AUXILIARY WINCH ASSEMBLY FOR MOVING A CRAWLER VEHICLE, IN PARTICULAR A SNOW GROOMER, ALONG STEEP SLOPES

(71) Applicant: PRINOTH S.p.A., Vipiteno (IT)

(72) Inventors: Mirko Insam, Ortisei (IT); Martin Runggaldier, S. Cristina (IT)

(73) Assignee: PRINOTH S.p.A., Vipiteno (IT)

( * ) Notice: Subject to any disclaimer, the term of this patent is extended or adjusted under 35 U.S.C. 154(b) by 360 days.

(21) Appl. No.: 15/329,445

(22) PCT Filed: Jul. 29, 2015

(86) PCT No.: PCT/IB2015/055730
§ 371 (c)(1),
(2) Date: Jan. 26, 2017

(87) PCT Pub. No.: WO2016/067127
PCT Pub. Date: May 6, 2016

(65) Prior Publication Data

US 2017/0210605 A1 Jul. 27, 2017

(30) Foreign Application Priority Data

Jul. 29, 2014 (IT) ..... MI2014A1376

(51) Int. Cl.
*B66D 1/38* (2006.01)
*B66D 1/56* (2006.01)
*E01H 4/02* (2006.01)

(52) U.S. Cl.
CPC ..... *B66D 1/38* (2013.01); *B66D 1/56* (2013.01); *E01H 4/02* (2013.01)

(58) Field of Classification Search
CPC .... B66D 1/38; B66D 1/56; B66D 2700/0191; E01H 4/02; B62D 55/00
See application file for complete search history.

(56) References Cited

U.S. PATENT DOCUMENTS

2004/0069981 A1 4/2004 Pelletier et al.
2006/0163546 A1 7/2006 Marcil
2012/0030974 A1* 2/2012 Runggaldier ..... E01H 4/02 37/235

FOREIGN PATENT DOCUMENTS

CN 201292232 8/2009
GB 1106253 3/1968

OTHER PUBLICATIONS

Notification of the Recording of a Change for International Application No. PCT/IB2015/055730 dated Feb. 25, 2016.

(Continued)

*Primary Examiner* — Sang K Kim
*Assistant Examiner* — Nathaniel L Adams
(74) *Attorney, Agent, or Firm* — Neal, Gerber & Eisenberg LLP

(57) ABSTRACT

A control device configured to control a winch assembly having a supporting structure has a guide, which engages a cable extending along a path in a sliding manner, and is configured to follow the movements of the cable crosswise to the path; a first control chain activated by movements of the guide in a first direction crosswise to the path; and a second control chain activated by movements of the guide in a second direction crosswise to the first direction and the path.

19 Claims, 5 Drawing Sheets

(56) References Cited

OTHER PUBLICATIONS

Notification Concerning Submission, Obtention or Transmittal of Priority Document for International Application No. PCT/IB2015/055730 dated Nov. 24, 2015.
Notification of Transmittal of the International Search Report and the Written Opinion for International Application No. PCT/IB2015/055730 dated Oct. 7, 2015.

* cited by examiner

DEVICE AND METHOD FOR CONTROLLING AN AUXILIARY WINCH ASSEMBLY FOR MOVING A CRAWLER VEHICLE, IN PARTICULAR A SNOW GROOMER, ALONG STEEP SLOPES

PRIORITY CLAIM

This application is a national stage application of PCT/IB2015/055730, filed on Jul. 29, 2015, which claims the benefit of and priority to Italian Patent Application No. MI2004A001376, filed on Jul. 29, 2014, the entire contents of which are each incorporated by reference herein.

BACKGROUND

Generally, certain known snow groomers comprise a cutter to manipulate the snow surface and a shovel to move snow masses along ski slopes. When the snow groomer works along a ski slope characterized by particularly steep slopes, the free end of the cable of the winch assembly is fixed to an anchorage, so as to operate the snow groomer with the help of the winch assembly, ensure relatively greater safety and/or prevent the groomer vehicle itself from skidding in case the groomer vehicle loses its grip on the snow surface. If, on the one hand, the winch increases relative safety along steep slopes, handling the cable, on the other hand, can give rise to certain drawbacks, in particular while the cable is being wound.

To avoid certain of these drawbacks, certain control devices are configured to control the cable and fulfill the function of positioning the cable both when the cable is unwound from the reel and when the cable is wound around the reel. In particular, certain control devices substantially fulfill the function of making sure that the cable is wound on the reel in a spiral shape having a defined pitch. However, these control device cannot detect possible abnormalities in the way in which the cable is wound and/or unwound.

SUMMARY

The present disclosure relates to a device configured to control an auxiliary winch assembly configured to move a crawler vehicle, in particular a snow groomer, along steep slopes.

In particular, a snow groomer comprises a frame; a control unit; and the winch assembly, which, in turn, comprises a supporting structure; a reel, which can rotate relative to the supporting structure; a cable, which can be wound around and unwound from the reel; an actuator assembly configured to rotate the reel around the axis; and a control device, which is mounted on the supporting structure and fulfils the function of controlling the cable while the cable is wound and unwound.

An advantage of the present disclosure is to provide a control device which is able to control the cable of a winch assembly in a relatively more effective way.

According to the present disclosure there is provided a control device configured to control a winch assembly having a supporting structure, the control device comprising a cable locator configured to position a cable of a winch assembly in a first direction; a guide, which is mounted on the cable locator in a movable manner, engages the cable extending along a path, and is configured to follow the movements of the cable crosswise to the path; a first control chain activated by movements of the guide in a first direction crosswise to the path; and a second control chain activated by movements of the guide in a second direction crosswise to the path and the first direction. In this way, users can make sure that the cable actually occupies the desired position, which is correlated with a specific operating phase of the winch assembly and can be determined through respective acceptability intervals or threshold values.

In particular, the first control chain extends between the guide and the cable locator and is configured to move the cable locator on the basis of the relative position between the guide and the cable locator, whereas the second control chain is configured to stop the cable on the basis of the position of the guide in the second direction and of a threshold value. In this way, the control device fulfils the dual function of guiding the cable during winding and unwinding operations and of avoiding possible drawbacks caused by a possible wrong positioning of the cable.

According to an embodiment of the present disclosure, the first and second control chain comprise a shared rocker arm, which comprises a base which oscillates about a first axis with respect to the cable locator, and an appendix which oscillates with respect to the base about a second axis; the guide being supported by the appendix. As such, based on the "articulated" rocker arm disclosed herein, the guide can follow and detect the movements of the cable in a plane crosswise to the path of the cable itself.

Another advantage of the present disclosure is to provide a winch assembly that can reduce certain of the drawbacks of certain of the known prior art.

According to the present disclosure there is provided a winch assembly for a crawler vehicle, in particular a snow groomer, the winch assembly comprising a supporting structure configured to mount on a snow groomer; a cable; a powered reel configured to selectively wind and unwind the cable; an idle sheave configured to support the cable; and a control device configured to control the position of the cable between the reel and the idle sheave. In this way, the control device can control the position of the cable between the reel and the idle sheave.

In particular, the winch assembly as claimed in the Claim comprises a control unit configured to acquire data relating to the winding status of the cable on the reel, and to supply threshold values for the position of the guide in the second direction. In this way, the admissible threshold for the position of the guide in the second direction can be regulated in a relatively fine manner, therefore avoiding false alarms.

A further advantage of the present disclosure is to provide a method for controlling a winch assembly, which is not affected by certain of the drawbacks of certain of the known prior art.

According to the present disclosure there is provided a method for controlling an auxiliary winch assembly configured to move a crawler vehicle, in particular a snow groomer, along steep slopes, wherein the winch assembly comprises a supporting structure; the method comprising the steps of engaging a cable in a guide fitted movably to a cable locator and configured to follow movements of the cable crosswise to the path; activating a first control chain via movements of the guide with respect to the cable locator in a first direction; and activating a second control chain via movements of the guide in a second direction.

Additional features and advantages are described in, and will be apparent from the following Detailed Description and the figures.

BRIEF DESCRIPTION OF THE DRAWINGS

Other features and advantages of the disclosure will be best understood upon perusal of the following description of a non-limiting embodiment thereof, with reference to the accompanying drawing, wherein.

DETAILED DESCRIPTION

Figure 1:
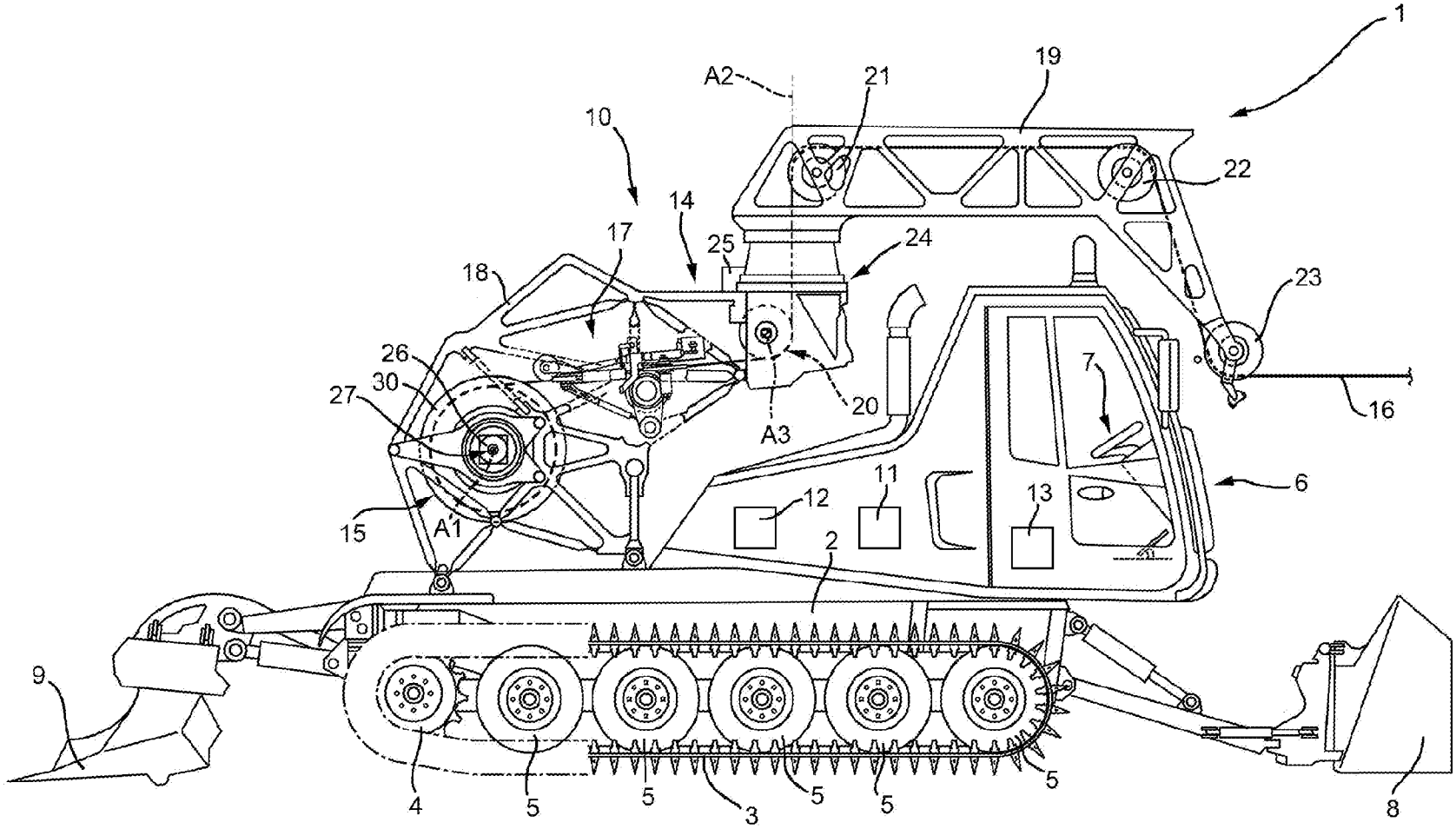
FIG. 1 is a side elevation view, with parts removed for greater clarity, of a snow groomer according to the present disclosure.

Referring now to the example embodiments of the present disclosure illustrated in FIGS. 1 to 5, with reference to FIG. 1, number 1 indicates, as a whole, a crawler vehicle, especially a snow groomer, which comprises a frame 2; two tracks 3 (only one of them is shown in FIG. 1); two drive wheels 4 (only one of them is shown in FIG. 1), which are operatively connected to the respective tracks 3; idler-wheels 5 configured to support the tracks 3; a cabin 6; a user interface 7 arranged in the cabin 6; a shovel 8, which is supported by the frame 2 on the front side; a cutter 9, which is supported by the frame 2 on the rear side; a winch assembly 10, which is fixed above the frame 2; an internal combustion engine 11; and a powertrain 12, which is operatively connected to the internal combustion engine 11; to the drive wheels 4; to the shovel 8; to the cutter 9; and to the winch assembly 10. The powertrain 12 can be hydraulic or electric or a combination thereof.

The snow groomer 1 comprises a control unit 13, which is connected to a user interface 7 and is configured to control the crawler vehicle 1 and the winch assembly 10.

The winch assembly 10 comprises a supporting structure 14, which is mounted on the frame 2; a reel 15, which is supported by the supporting structure 14 so as to rotate around an axis A1; a cable 16, which has an end fixed to the reel 15 and is partly wound around the reel 15; a control device 17 configured to control the cable 16 when the cable is unwound from the reel 15 and wound on the reel 15. In the example shown, the supporting structure 14 comprises a portion 18 that is integral to the frame 2 and a portion 19 that is mounted on the portion 18 so as to rotate around an axis A2, in order to aim the cable 16 at an anchoring point of the cable 16 regardless of the orientation of the crawler vehicle 1 relative to the anchoring point (which is not shown in the accompanying figures). The portion 18 of the supporting structure 14 supports the reel 15, an idle sheave 20, which can rotate around an axis A3 that is parallel to the axis A1 of the reel 15, and the control device 17, which is arranged between the reel 15 and the idle sheave 20. The portion 19 comprises idle sheaves 21, 22 and 23.

The supporting structure 14 comprises a fifth wheel coupling 24, which is interposed between the portion 18 and the portion 19; a powered mechanism 25, which is operatively coupled to the fifth wheel coupling 24 so as to selectively rotate the portion 19 around the axis A2 relative to the portion 18.

The winch assembly 1 further comprises an actuator assembly 26, which is operatively connected to the reel 15 and is configured to rotate the reel 15 around the axis A1 in opposite directions; and a sensor 27, which is coupled to the reel 15 so as to detect the position of the reel 15 around the axis A1. The angular position of the reel 15 enables users to calculate the quantity of cable 16 wound on the reel 15 and the quantity of cable 16 on the outside of the reel 15.

Figure 2:
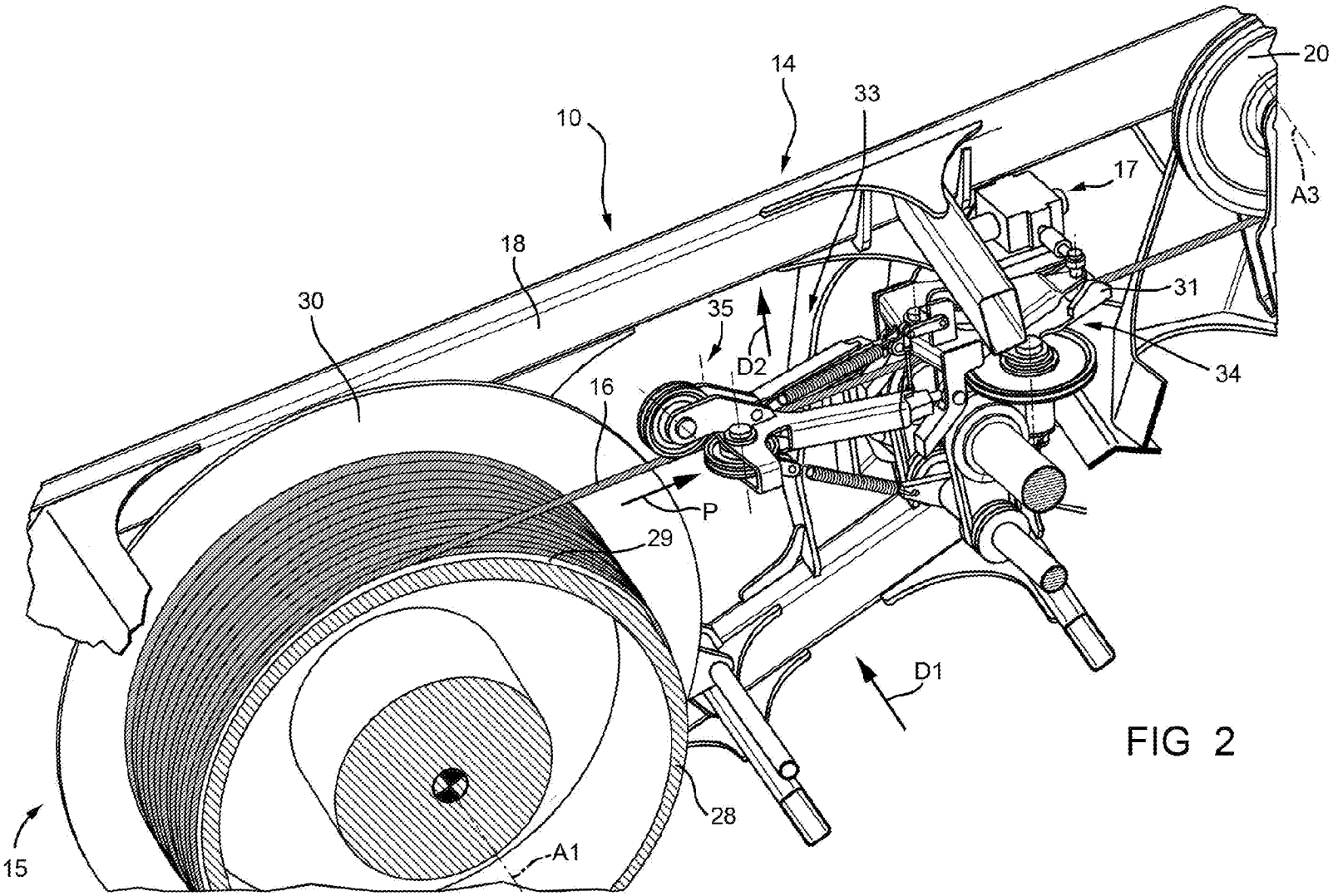
FIG. 2 is a perspective view, with parts removed for greater clarity and on a larger scale, of the winch assembly of the snow groomer shown in FIG. 1.

With reference to FIG. 2, the reel 15 comprises a cylindrical body 28, along which a helical recess 29 is obtained, and two flanges 30, which are perpendicular to the axis A1. Only one of the two flanges 30 is shown in FIG. 1. The flanges 30 fulfil the function of keeping the cable 16 in an orderly configuration, especially when the cable 16 is wound on one or more portions of cable 16 that were previously wound in a spiral shape. Due to the fact that the cable 16 is wound on the reel 15 and unwound from the reel 15 in an orderly fashion, it is possible to define the point of tangency of the cable 16 on the reel 15 in any operating instant.

Figure 3:
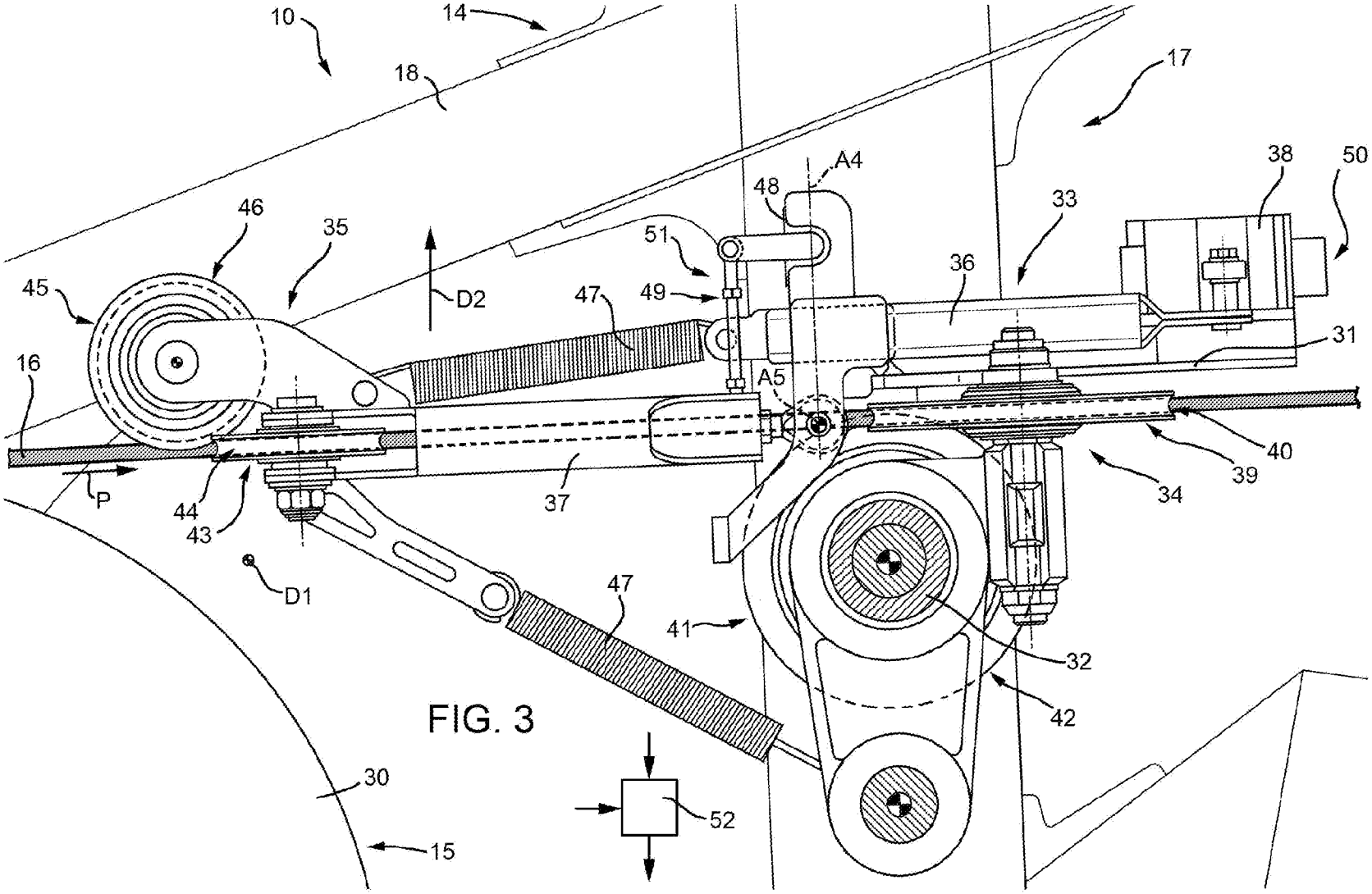
FIG. 3 is a side elevation view, with parts removed for greater clarity and on a further larger scale, of a detail of the winch assembly of FIG. 2.
Figure 4:
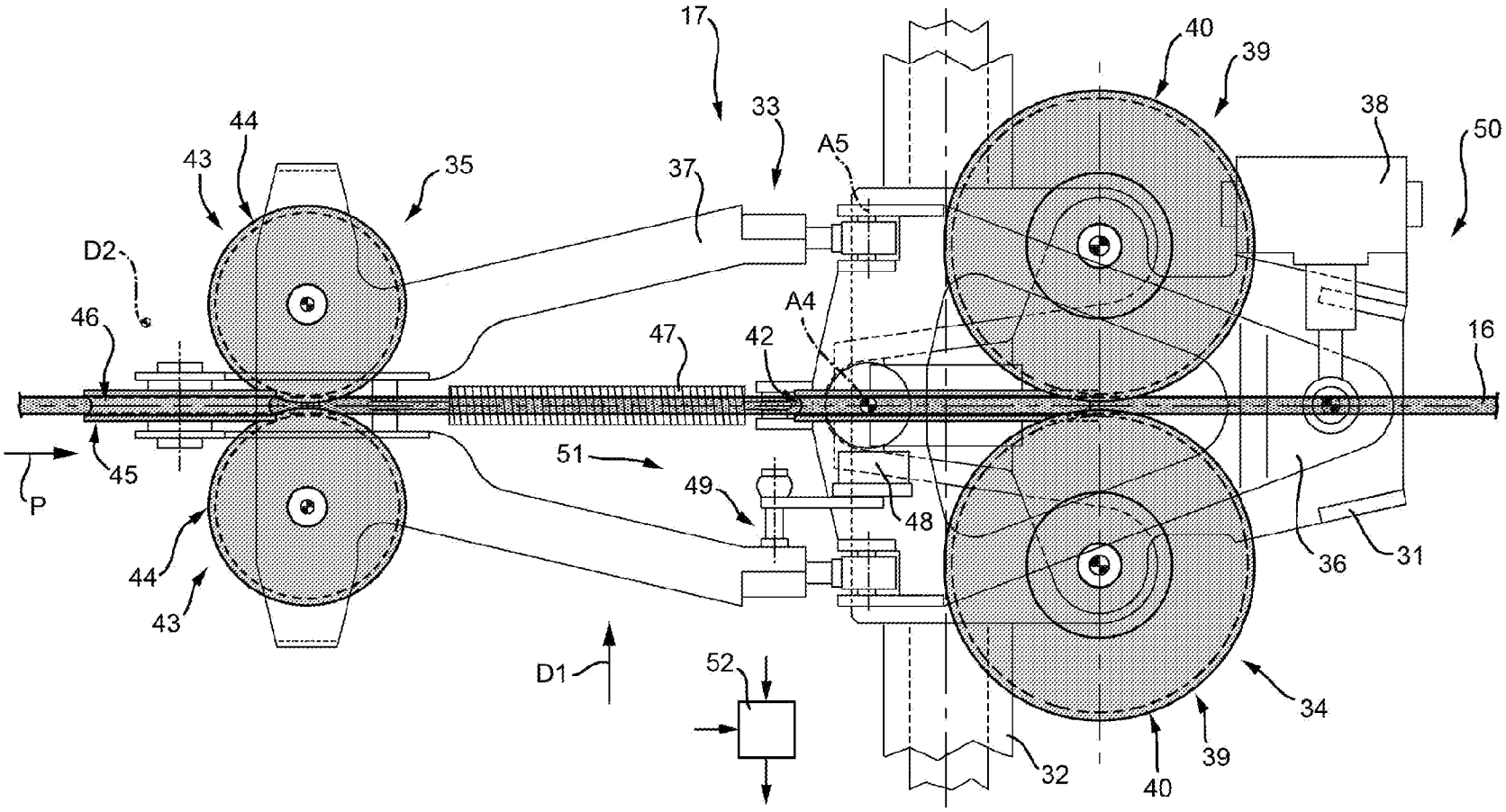
FIG. 4 is a plan view, with parts removed for greater clarity, of a control device of the winch assembly according to the present disclosure.

With reference to FIGS. 3 and 4, the control device 17 comprises a cable locator 31, which engages the cable 16, and is movable relative to the supporting structure 14 in a direction D1 that is parallel to the axis of the reel 15 (perpendicular to the plane of the sheet in FIG. 3); an actuator 32 to selectively move the cable locator 31 in the direction D1, and a rocker arm 33, which engages the cable 16 and oscillates with respect to the cable locator 31 around an axis A4 that is perpendicular to the direction D1.

Figure 5:
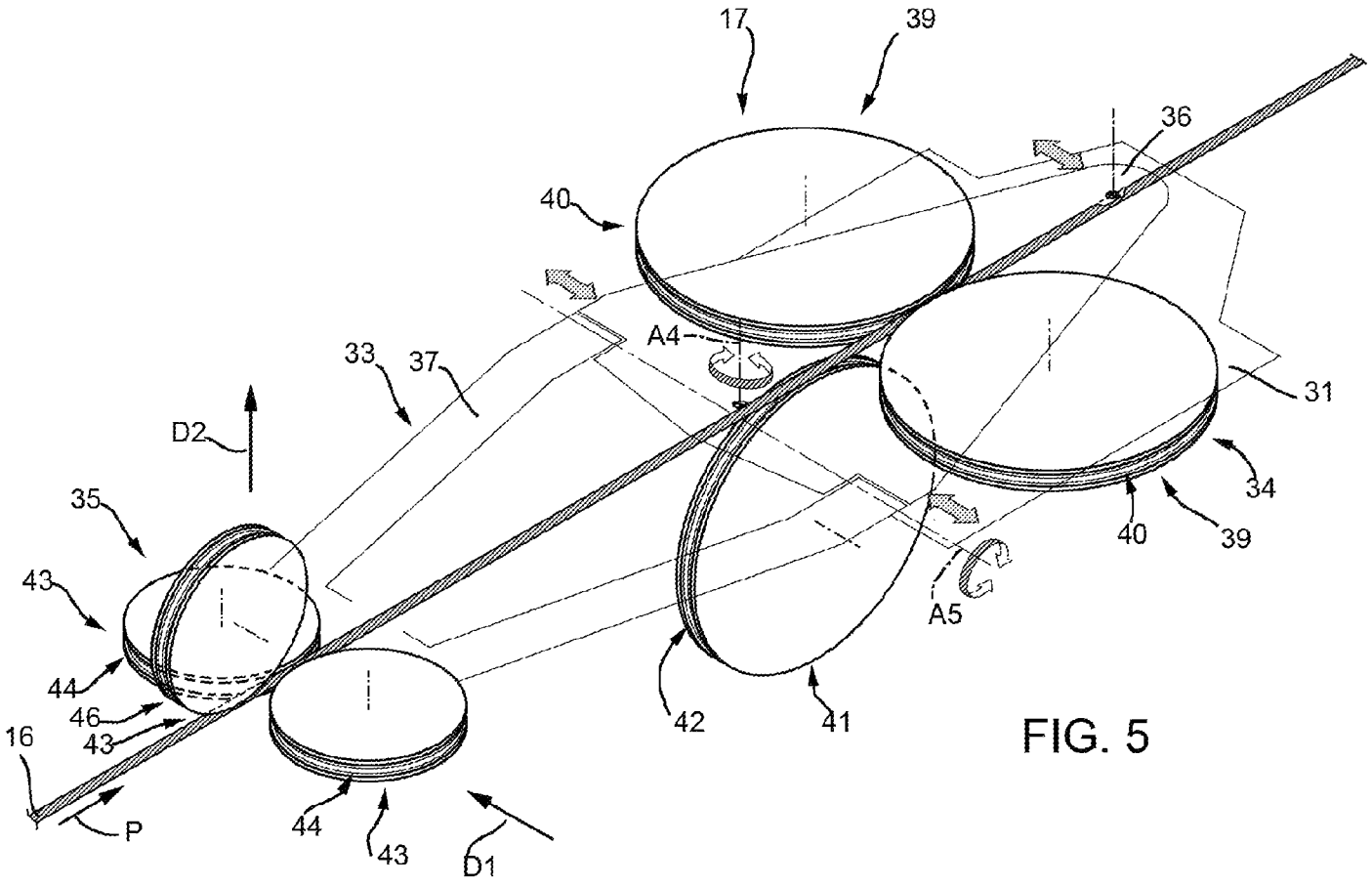
FIG. 5 is a perspective view, with parts removed for greater clarity, of the control device of FIG. 4.

According to the schematic view of FIG. 5, the cable locator 31 engages the cable 16 with a guide 34, whereas the rocker arm 33 engages the cable 16 with a guide 35. The rocker arm 33 comprises a base 36, which is mounted on the cable locator 31 so as to rotate around the axis A4, and an appendix 37, which is mounted so as to rotate with respect to the base 36 around an axis A5. The axes A4 and A5 are transverse to one another and, in this case, are perpendicular to one another. Hence, the rocker arm 33 is articulated around the axis A5, which is perpendicular to the axis A4.

With reference to FIGS. 4 and 5, the control device 17 comprises an actuating device 38, in this case a hydraulic distributor, of the actuator 32. The actuating device 38 is mechanically connected to the rocker arm 33, so that the rotation of the rocker arm 33 around the axis A4 with respect to the cable locator 31 determines a status variation in the actuating device 38 and a given or designated movement of the actuator 32, such as to re-establish the relative position between the rocker arm 33 and the cable locator 31.

The guide 34 comprises two coplanar sheaves 39 with the respective grooves 40 facing one another in the respective point of tangency with the cable 16, so as to enclose the cable 16 between the grooves 40 themselves, as well as a sheave 41 that is perpendicular to the sheaves 39, is arranged under the sheaves 39 and is provided with a groove 42. The sheave 41 is slightly not aligned with the sheaves 39 along the path P of the cable 16, so as to not interfere with the sheaves 39.

Similarly, the guide 35 comprises two coplanar sheaves 43 with the respective grooves 44 facing one another, so as to enclose the cable 16 between the grooves 44 in the respective points of tangency, as well as a sheave 45 that is perpendicular to the sheaves 43, is arranged above the sheaves 43 and is provided with a groove 46. The sheave 45 is slightly not aligned, so as to not interfere with the sheaves 43.

The appendix 37 is elastically kept in a balance position relative to the base 36. In the example shown, elastic elements 47 connect the appendix 37 to the base 36 and to the cable locator 31, respectively.

The control device 17 comprises a sensor 48 to detect the relative angular position between the appendix 37 and the base 36 of the rocker arm 33. In the example shown, the sensor 48 is mounted on the base 36 and is connected to the appendix 37 via a mechanical transducer 49.

With reference to FIG. 5, the control device 17 is sensitive to the movements of the guide 35 both in the direction D1 and in the direction D2.

With reference to FIG. 4, a movement of the guide 35 in the direction D1 triggers a control chain 50, which determines the movement of the cable locator 31 in the direction D1, until the appendix 37 is in the relative position with respect to the cable locator 31 before the movement of the cable locator 31. In the example shown, the kinematic chain 50 is mechanical-hydraulic and comprises the rocker arm 33, the actuating device 38 and the actuator 32.

With reference to FIG. 3, a movement of the guide 35 in the direction D2 triggers a control chain 51, which determines the stop of the cable 16 and of the winch assembly 10, when the movement in the direction D2 exceeds a given or designated threshold value. The control chain 51 is mechatronic and comprises the appendix 37; the sensor 48; the mechanical powertrain 49; and a control unit 52, which fulfils the function of emitting an error signal to stop the cable 16, when the position of the guide 35 in the direction D2 exceeds a threshold value.

According to a particular embodiment of the disclosure, the control unit 52 is connected to the sensor 27 of the reel 15, so as to be able to calculate the expected tangency position of the cable 16 relative to the cylindrical body 28 or to a layer of wound cable 16. Based on the signals emitted by the sensor 27, users can calculate the expected position of the guide 35 and, as a consequence, threshold values and acceptability intervals for the position of the guide in the direction D2.

In use and with reference to FIG. 2, when the cable 16 is wound and unwound on the reel 15, the cable 16 is moved by the control device 17 parallel to the axis A1 of the reel 15 so as to cause the cable 16 to be arranged in a predetermined spiral shape and, at the same time, the position of the guide 35 in the direction D2 is controlled so as to detect possible abnormal positions of the cable 16. Accordingly, if the cable were to move beyond the flange 30 of the reel 15, the guide 35 would end up in an abnormal position and the cable 16 would be stopped in order to avoid possible damages to the winch assembly 10.

Furthermore, it is evident the present disclosure also covers embodiments that are not described in the detailed description above as well as equivalent embodiments that are part of the scope of protection set forth in the appended Claims. As such, changes may be made to the embodiments of the present disclosure described with reference to the attached drawings without, however, departing from the protective scope of the accompanying Claims. Accordingly, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A crawler vehicle winch assembly control device comprising:

a cable locator configured to position a cable of a winch assembly having a supporting structure;

a guide configured to:

engage the cable which extends along a path, and follow movements of the cable crosswise to the path;

a first control chain activated by a movement of the guide in a first direction crosswise to the path; and a second control chain activated by a movement of the guide in a second direction crosswise to the first direction and crosswise to the path, wherein the second control chain is configured to stop, based on a position of the guide in the second direction and a threshold value of cable displacement in the second direction, at least one of: a winding of the cable and an unwinding of the cable by stopping a rotation of a powered reel.

2. The crawler vehicle winch assembly control device of claim 1, wherein the first control chain includes the guide and a cable locator, said first control chain being configured to move the cable locator based on a relative position between the guide and the cable locator.

3. The crawler vehicle winch assembly control device of claim 1, wherein the first control chain and the second control chain include a shared rocker arm including:

a base configured to oscillate about a first axis with respect to the cable locator, and an appendix configured to oscillate with respect to the base about a second axis, wherein the guide is supported by the appendix.

4. The crawler vehicle winch assembly control device of claim 3, wherein the first axis is parallel to the second direction, and the second axis is parallel to the first direction.

5. The crawler vehicle winch assembly control device of claim 3, wherein the first axis is perpendicular to the second axis.

6. The crawler vehicle winch assembly control device of claim 3, which includes at least one elastic member configured to push the appendix downwards.

7. The crawler vehicle winch assembly control device of claim 1, wherein the first control chain includes:

an actuator configured to move the cable locator in the first direction; and an actuating device configured to activate the actuator and controlled by the movement of the guide in the first direction.

8. The crawler vehicle winch assembly control device of claim 1, wherein the second control chain includes a sensor configured to detect a position of the guide in the second direction.

9. The crawler vehicle winch assembly control device of claim 8, wherein the second control chain includes a control unit configured to emit an error signal based on a threshold value of cable displacement in the second direction and the detected position of the guide in the second direction.

10. The crawler vehicle winch assembly control device of claim 1, wherein the guide includes:

two first sheaves coplanar with each other, wherein a seat of each of the two first sheaves are facing at first points of tangency to the cable; and a second sheave perpendicular to the first sheaves and tangent to the cable at a second point of tangency offset along the path of the cable.

11. The crawler vehicle winch assembly control device of claim 1, which includes another guide for the cable, wherein a position of the other guide in the first direction is controlled by the first control chain.

12. A crawler vehicle winch assembly comprising:

a supporting structure configured to mount on a crawler vehicle;

a cable;

a powered reel configured to selectively wind and unwind the cable;

an idle sheave configured to support the cable; and a control device configured to control a position of the cable between the powered reel and the idle sheave, said control device including:

a cable locator configured to position the cable;

a guide configured to:

engage the cable which extends along a path, and follow movements of the cable crosswise to the path;

a first control chain activated by a movement of the guide in a first direction crosswise to the path; and a second control chain activated by a movement of the guide in a second direction crosswise to the first direction and crosswise to the path, wherein the second control chain is configured to stop, based on a position of the guide in the second direction and a threshold value of cable displacement in the second direction, at least one of: a winding of the cable and an unwinding of the cable by stopping a rotation of the powered reed.

13. The crawler vehicle winch assembly of claim 12, which includes a control unit configured to:

acquire data relating to a winding status of the cable on the powered reel, and supply a threshold value for a position of the guide in the second direction.

14. The crawler vehicle winch assembly of claim 12, wherein the crawler vehicle includes a snow groomer.

15. A crawler vehicle winch assembly control device comprising:

a cable locator configured to position a cable of a winch assembly having a supporting structure;

a guide configured to:

engage the cable which extends along a path, and follow movements of the cable crosswise to the path;

a first control chain activated by a movemement of the guide in a first direction crosswise to the path;

a second control chain including a sensor configured to detect a position of the guide in a second direction crosswise to the first direction and crosswise to the path, the second control chain activated by a movement of the guide in the second direction, wherein the second control chain is configured to stop, based on a position of the guide in the second direction and a threshold value, at least one of: a winding of the cable and an unwinding of the cable; and a shared rocker arm shared of the first control chain and the second control chain, the rocker arm including:

a base configured to oscillate about a first axis with respect to the cable locator, and an appendix configured to oscillate with respect to the base about a second axis wherein the guide is supported by the appendix.

16. The crawler winch assembly control device of claim 15, wherein the first axis is perpendicular to the second axis.

17. The crawler vehicle winch assembly control device of claim 15, wherein the first axis if perpendicular to the second axis.

18. The crawler vehicle winch assembly control device of claim 15, which includes at least one elastic member configured to push the appendix downwards.

19. The crawler vehicle winch assembly control device of claim 15, wherein the second control chain includes a control unit configured to emit an error signal based on the threshold value and the detected position of the guide in the second direction.

* * * * *